US007097002B2

(12) United States Patent
Bisang et al.

(10) Patent No.: US 7,097,002 B2
(45) Date of Patent: Aug. 29, 2006

(54) ELEVATOR DOOR DRIVE DEVICE

(75) Inventors: Daniel Bisang, Baar (CH); Jürgen Lütolf, Cham (CH); Frank Thielow, Bodnegg (DE)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/005,723

(22) Filed: Dec. 7, 2004

(65) Prior Publication Data

US 2005/0126861 A1 Jun. 16, 2005

(30) Foreign Application Priority Data

Dec. 8, 2003 (EP) ..... 03405875

(51) Int. Cl.
*B66B 13/12* (2006.01)

(52) U.S. Cl. ..... 187/319; 187/330; 187/335; 187/315

(58) Field of Classification Search ..... 187/319, 187/330, 331, 335; 49/116, 120
See application file for complete search history.

(56) References Cited

U.S. PATENT DOCUMENTS 4,947,964 A * 8/1990 Husmann ..... 187/319
5,246,089 A * 9/1993 Husmann et al. ..... 187/319
6,021,871 A * 2/2000 Grabner ..... 187/335

FOREIGN PATENT DOCUMENTS

| | | |
|---|---|---|
| EP | 0 332 841 | 9/1989 |
| FR | 2 823 495 | 10/2002 |
| FR | 2823495 A1 * | 10/2002 |
| WO | WO 03/089356 | 10/2003 |

* cited by examiner

*Primary Examiner*—Kathy Matecki
*Assistant Examiner*—Stefan Kruer
(74) *Attorney, Agent, or Firm*—Butzel Long

(57) ABSTRACT

An elevator door drive device, which opens and closes at least one car door leaf and a corresponding shaft door leaf, includes a coupling mechanism mounted at the car door leaf for transmitting the car door leaf movement to the shaft door leaf with two parallel entraining runners mounted on pivotable adjusting elements. The spacing between the runners is adjustable and a drive unit transmits closing and opening movements to the car door leaf by way of a drive apparatus that leads the entraining runners to a coupling element at the shaft door leaf before the start of the opening movement and moves them away from the coupling element after the end of the closing movement. The pivotable adjusting elements, during opening or closing the door leaf are blocked by means of a catch acting in both pivot directions.

12 Claims, 7 Drawing Sheets

ELEVATOR DOOR DRIVE DEVICE

BACKGROUND OF THE INVENTION

The present invention relates to an elevator door drive device for opening and closing at least one car door leaf and at least one associated shaft door leaf of an elevator.

The present invention further relates to the problem of transmitting the opening and closing movement, which is produced by a car door drive, from at least one car door leaf to the associated shaft door leaf.

A door drive device with a coupling mechanism for coupling a card door leaf with an associated shaft door leaf has become known from European Patent Specification EP 0 332 841. The coupling mechanism comprises two entraining runners which are oriented to be parallel to the travel direction of the elevator car and which are adjustable in their mutual spacing by a parallelogram guide with two adjusting elements each pivotable about a respective pivot axis. If the elevator car is correctly disposed at a floor level, the two entraining runners lie between two coupling elements arranged adjacent to one another at the shaft door leaf and can be laterally guided up to these (spread) in order on the one hand to unlock the shaft door leaf and on the other hand to transmit the opening and closing movement of the car door to the car door leaf in play-free manner and synchronously. The adjustment of spacing between the two entraining runners in that case takes place by a door drive unit, which is fastened to the car door frame, by way of a linearly acting drive means (for example, by a belt drive), which also produces the closing and opening movements of the car door leaf. In that case the drive means so engages at the car door leaf by way of a pivot lever connected with the adjusting elements of the parallelogram guide that through the opening movement of the linearly acting drive means the adjusting elements are pivoted, before the start of a door leaf opening movement, into a setting in which the entraining runners are led up to the coupling elements, thereby unlock the shaft door leaf and form the said coupling between the car door leaf and the corresponding shaft door leaf.

At the end of the door leaf closing movement the adjusting elements are pivoted by the closing movement of the linearly acting drive means back into a setting in which the entraining runners are spaced from the coupling elements so that the locking of the shaft door leaf in its locked position returns.

In order to guarantee that the door leaf opening movement begins only when the entraining runners are fully spread and thus the shaft door leaf unlocked, a tension spring ensures that the spreading of the entraining runners takes place automatically even against the resistance of the shaft door unlocking. This has the consequence that at the start of the door opening process the drive means is driven by the tension spring in opening direction until the pivot lever is fully pivoted out in opening direction and that at the end of the closing process, i.e. on reversing the spreading of the entraining runners, the drive means has to work against the action of the relatively strong tension spring.

The door drive device shown in the EP 0 332 841 document has a number of disadvantages.

In order to ensure that on changeover the drive direction from the door leaf opening movement to the closing movement the adjusting elements are not prematurely pivoted back as a consequence of acceleration forces, i.e. the entraining runners do not space themselves from the coupling elements, the pivoting back of the pivot lever arranged between the drive means and one of the pivotable adjusting elements is prevented by a catch lever. This has the form of a double-armed, horizontally extending lever mounted at the door leaf. When the door leaf is disposed in its closed setting, the first arm of the catch lever lies on a support roller fastened to the car door frame and the second arm extends horizontally below an abutment dog which is present at the pivot lever and by way of which the drive means acts on the one adjusting element. The catch lever is so loaded with a torque about its fulcrum by a torsion spring that the second arm moves upwardly when the first arm is no longer supported. If the drive means at the beginning of the door leaf opening movement pivots the pivot lever together with the adjusting element in clockwise sense and thus has spread the entraining runners and subsequently the car door leaf has opened so far that the catch lever fastened thereto is no longer supported by the support roller, the second arm of the catch lever moves upwardly to the height of the abutment dog at the pivot lever and prevents the pivot lever and the adjusting element from pivoting back. Before, after reversal of the drive direction, the door leaf has reached the end of the closing movement the first arm of the catch lever is raised by the support roller, wherein the second arm moves downwardly and frees the abutment dog of the pivot lever so that the drive means can move the pivot lever, adjusting element and entraining runners into the initial setting in which the entraining runners are spaced from the coupling elements.

The disadvantages of this equipment are that the catch lever does not lock the pivot lever and the adjusting element in both pivot directions and does not lock them free of play. This can have the consequence on the one hand that the spacing between the spread entraining runners varies, which can have a negative effect on the unlocking process in the case of shaft doors and impairs the accuracy of the closing process in the case of the shaft doors, which can lead to the locking thereof not taking place correctly and triggering of a fault in operation. On the other hand, any play which is present, particularly in the case of rapidly moved and strongly accelerated door leaves, can produce disruptive noises.

SUMMARY OF THE INVENTION

The present invention creates equipment of the aforedescribed kind which avoids the stated disadvantages, i.e. in which the adjusting elements and thus the entraining runners are accurately positioned in the entraining setting thereof and are locked in both directions free of play.

The advantages achieved by the present invention are that an elevator door drive device similar to the described state of the art has a coupling mechanism in which one of the adjusting elements moving the entraining runners or a blocking element connected therewith has a recess, which is radially spacing from the axis of rotation of the adjusting element, or a projection, for example a groove or a lug, with which a complementary shaped portion at a catch cooperates in order to temporarily block a pivot movement of the adjusting element in both pivot directions and free of play.

Advantageously, the recess or the projection at the adjusting element or at the blocking element connected therewith as well as the complementary shaped portion at the catch are so arranged that they come accurately into mutual engagement when the linearly acting drive means before the start of a door leaf opening movement has brought the entraining runners to a spacing in which these are led in intended manner up to the at least one coupling element. This setting usually produces, apart from correct movement of the shaft door, also faultless unlocking thereof.

According to a preferred form of embodiment the elevator door drive device comprises a catch abutment which is connected with the elevator car or with an elevator shaft (for example, with a shaft door frame) and on which the catch impinges at the start of a last travel section of the door leaf closing movement. The catch is thereby so pivoted when covering this last travel section that the blocking of the pivot movement of the adjusting element by the catch is cancelled and wherein catch and catch abutment are so shaped and arranged, wherein the relative movement between the catch abutment and the catch and thus the abutment force acting on the catch act in substantially the same direction in which the complementary shaped portion at the catch moves away from the recess or from the projection at the adjusting element. It is thus achieved that the catch can be brought out of its engagement with the adjusting element with the smallest expenditure of force and that the position of the door leaf in which the unlatching takes place can be set simply and precisely, for example in that the catch abutment has a lockable adjusting screw.

The adjustable catch abutment is preferably so adjusted that the length of the last travel section, which is mentioned in the preceding paragraph, of the door leaf closing movement is less than six millimeters. Thanks to the precise unlatching mechanism of the equipment according to the present invention it is possible in the door leaf closing process to release the pivot lever—termed pivot and blocking plate in the following—transmitting the drive movement of the door leaf for pivoting back only very shortly before reaching of the absolute closed setting of the door leaf. It can thereby be reliably guaranteed that the spread setting of the entraining runners is maintained until the shaft door leaf has reached its closed setting to such an extent that the automatically acting shaft door lock can detent.

A further advantageous development of the present invention is that the catch is a lever pivotably mounted on a component connected with the car door leaf and that the position of the point of impinging of the catch abutment on the catch between the fulcrum thereof and its point of engagement with the adjusting element is so selected that the complementary shaped portion at the catch, which is disposed in engagement with the recess or the projection at the setting element, in the course of the stated last travel section of the door leaf closing movement moves away from its engagement position by a travel which is greater by comparison with this travel section. With given depths of engagement between the complementary shaped portion at the catch and the recess or the projection at the adjusting element the position of the door leaf, in which the unblocking of the pivot and blocking plate takes place and the shaft door coupling is cancelled, can thus displace to optimum proximity with respect to the absolute closed setting.

In the case of car and shaft doors each with at least two centrally closing door leaves and two coupling mechanisms each mounted at a respective car door leaf, the catches of the two coupling mechanisms are, according to a particularly interesting form of embodiment of the invention, each moved away from the engagement position thereof by a respective one of the ends of a double catch abutment arranged between the two catches and displaceable in movement direction of the two door leaves. This equipment makes it possible, to work with minimum last travel sections for the unblocking of the adjusting elements even when larger lateral offsets arise between car door and shaft door.

According to a further embodiment of the present invention the elevator door drive device comprises a restraining device which on initiation of a door leaf opening movement enables a displacement of the closed door leaf only when the adjusting element before the start of the door leaf opening movement is pivoted by the linearly acting drive means virtually completely into the setting in which the entraining runners are led up to the at least one coupling element. It can be guaranteed by such a device that the door leaf opening movement in all circumstances begins only when the entraining runners are fully spread and thus the shaft door leaf unlocked, without a strong spring—as previously mentioned—having to drive the spreading process. The door drive in the case of this embodiment is not driven at the start of the opening process by way of the drive means via a strong tension spring and thus does not have to work against this at the end of the closing process. Motor power and regulating cost can thereby be reduced.

According to an advantageous form of embodiment the restraining device comprises a pivotable restraining catch which keeps the door leaf at the beginning of a door opening process locked in its closed setting relative to the elevator car until the adjusting element before the start of the door leaf opening movement is pivoted by the linearly acting drive means virtually completely into the setting in which the entraining runners are led up to the at least one coupling element. The pivotable restraining catch has the advantage that it can be unlatched in simple manner by a cam connected with the adjusting element.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1A:
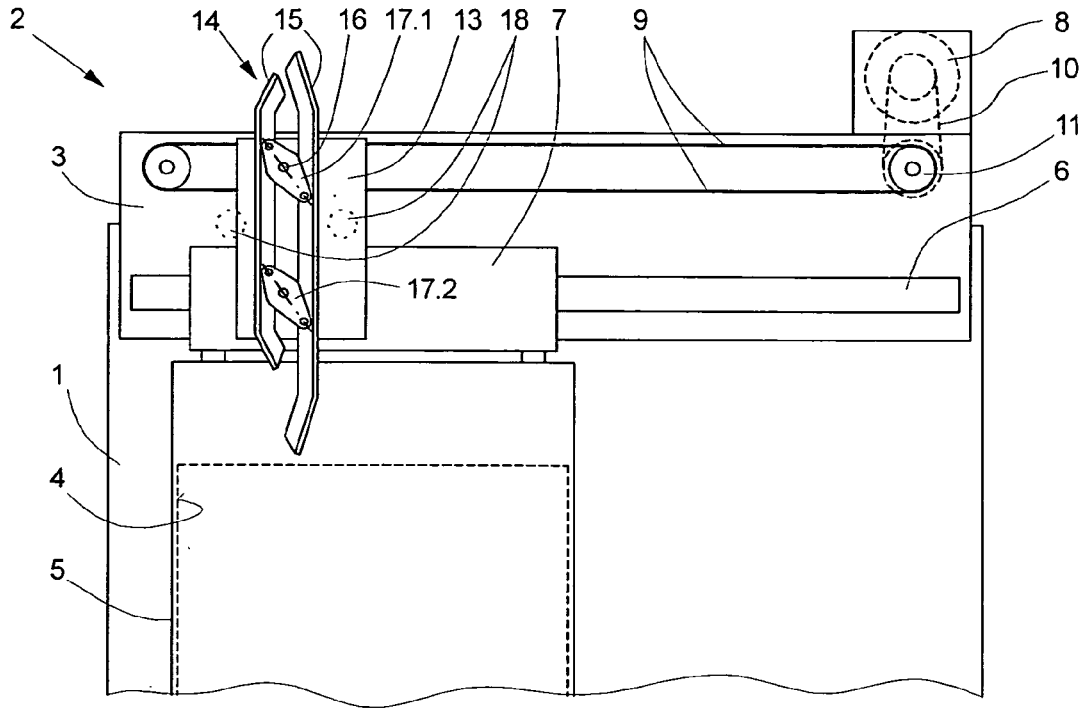
FIG. 1A is fragmentary schematic view of an elevator car with an elevator door drive device for a laterally closing a single-leaf door with entraining runners which are not spread in accordance with the present invention.
Figure 1B:
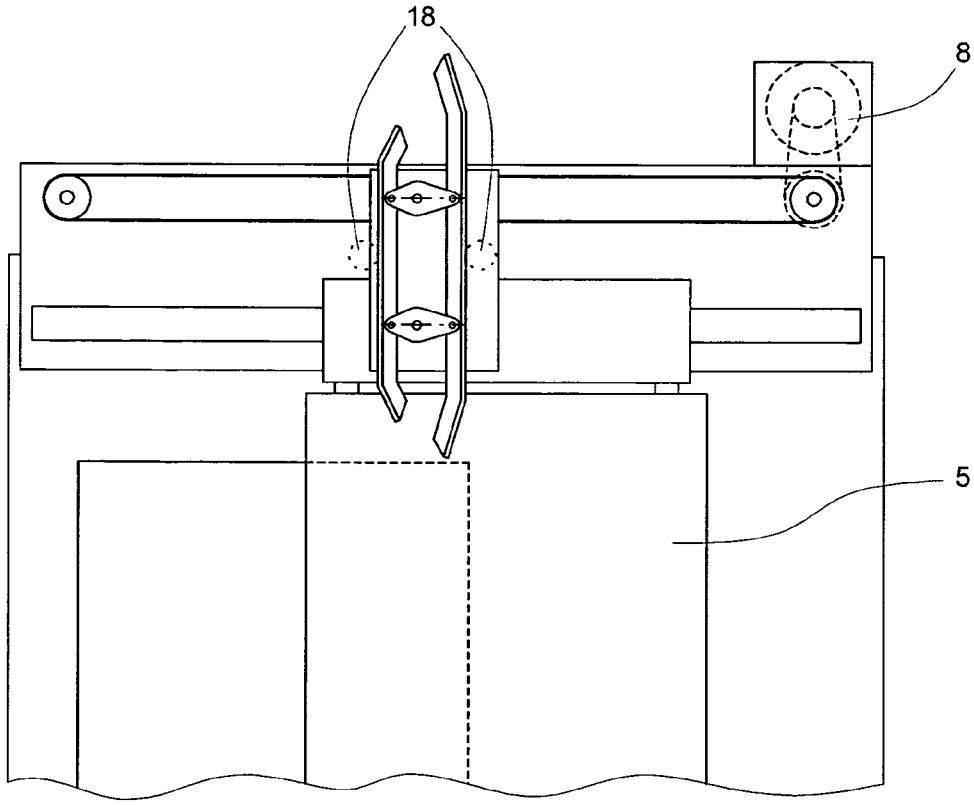
FIG. 1B is a view similar to FIG. 1A with the entraining runners spread.

FIGS. 1A and 1B schematically show an elevator door drive device 2, which is mounted at an elevator car 1, for a laterally closing single-leaf door. The elevator car 1 with a door opening 4, which is closable by a car door leaf 5, can be seen. The elevator door drive device 2 is installed on a door support 3 fastened to the elevator car 1. The door leaf 5 is fastened to a suspension carriage 7 which is laterally displaceable along a guide rail 6, fixed to the door support and which is moved between a door leaf opening setting and a door leaf closed setting by a drive unit 8 via a linearly acting, circulating drive means 9. An electric motor, which drives a drive pulley 11 of the linearly acting drive means 9 at a regulated or an unregulated rotational speed by way of a transmission 10, can serve as the drive unit 8. The linearly acting drive means 9 can be a cogged belt, a flat belt, a V-belt or also a roller chain.

A base plate 13, on which a coupling mechanism 14 for transmitting the movement of the car door leaf to a shaft door leaf (not visible) associated therewith is installed, is fastened to the suspension carriage 7. The coupling mechanism 14 comprises two entraining runners 15 oriented to be parallel to the direction of travel of the elevator car 1 and mounted on two adjusting elements 17.1, 17.2, which are each pivotable about a respective pivot axle 16 and are adjustable, by pivoting of these adjusting elements, in their mutual spacing, i.e. can adopt an unspread or a spread setting.

Two coupling elements 18—here in the form of coupling rollers—are present each time at the shaft door leaves of all floor doors and protrude so far into the shaft space near the entraining runners 15 that these in a spread state can transmit laterally (horizontally) directed forces and movements to the coupling elements 18 and the corresponding shaft door leaf insofar as the elevator car 1 is disposed in the region of a floor level. The shaft door leaves associated with the illustrated car door leaves 5 are, for reasons of clarity, not visible in all figures which are present and the coupling elements 18 mounted at the shaft door leaves are therefore illustrated only by means of so-termed phantom lines.

Pivoting of the adjusting elements 17.1, 17.2 and thus adjusting of the spacing between the entraining runners 15 similarly takes place by the drive unit 8 via the linearly acting drive means 9. The operating principle of the adjustment of spacing (spreading) is explained in connection with FIG. 3A.

FIG. 1A shows the setting of the coupling mechanism 14 during travel of the elevator car 1, i.e. with closed car and shaft door leaves. In this situation the entraining runners 15 adopt their unspread setting in which they can move through in vertical direction between the coupling elements 18 mounted adjacent to one another at the shaft door leaves.

FIG. 1B shows the situation in which the elevator car 1 is disposed at the level of a floor opposite a shaft door and the entraining runners 15 have been spread, so that these come into contact with the two coupling elements 18 at the shaft door leaf and in co-operation with these coupling elements 18 form a play-free coupling between the car door leaf 5 and the associated shaft door leaf. In the illustrated situation the drive unit 8 has already partly opened the car door leaf 5 and, with this, also the associated shaft door leaf. Unlocking of the shaft door leaf, which is not further described here, usually takes place at the beginning of the door opening process by the action of the entraining runners 15 on at least one of the coupling elements 18.

Figure 2A:
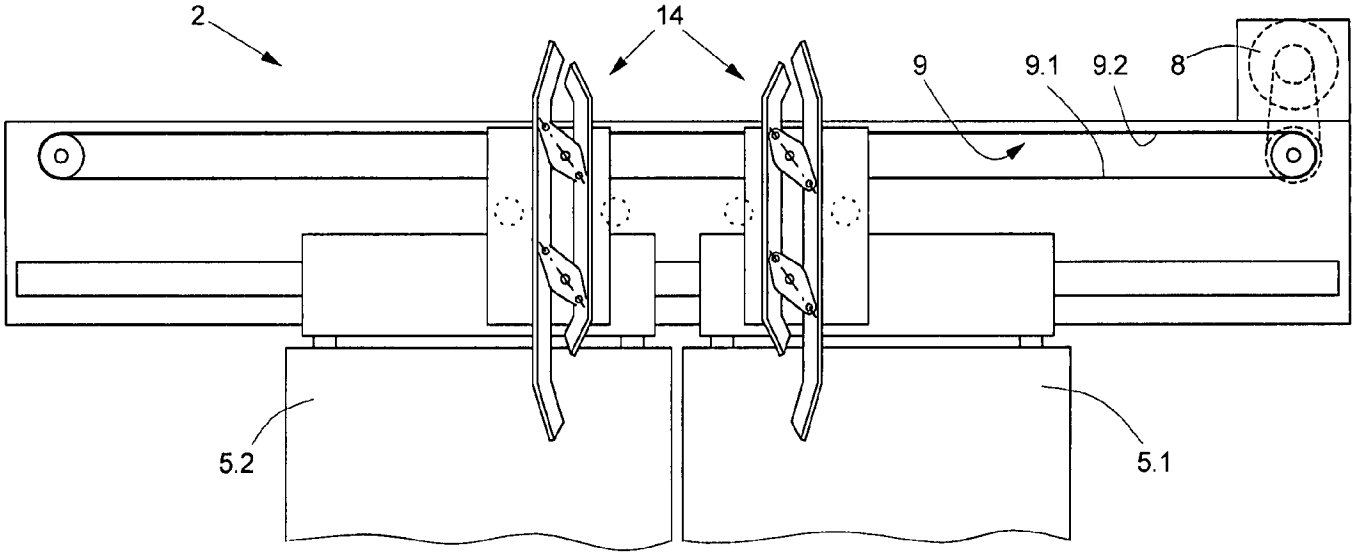
FIG. 2A is a fragmentary schematic view of an elevator car with an elevator door drive device for a centrally closing multi-leaf door with entraining runners which are not spread in accordance with an alternate embodiment of the present invention.
Figure 2B:
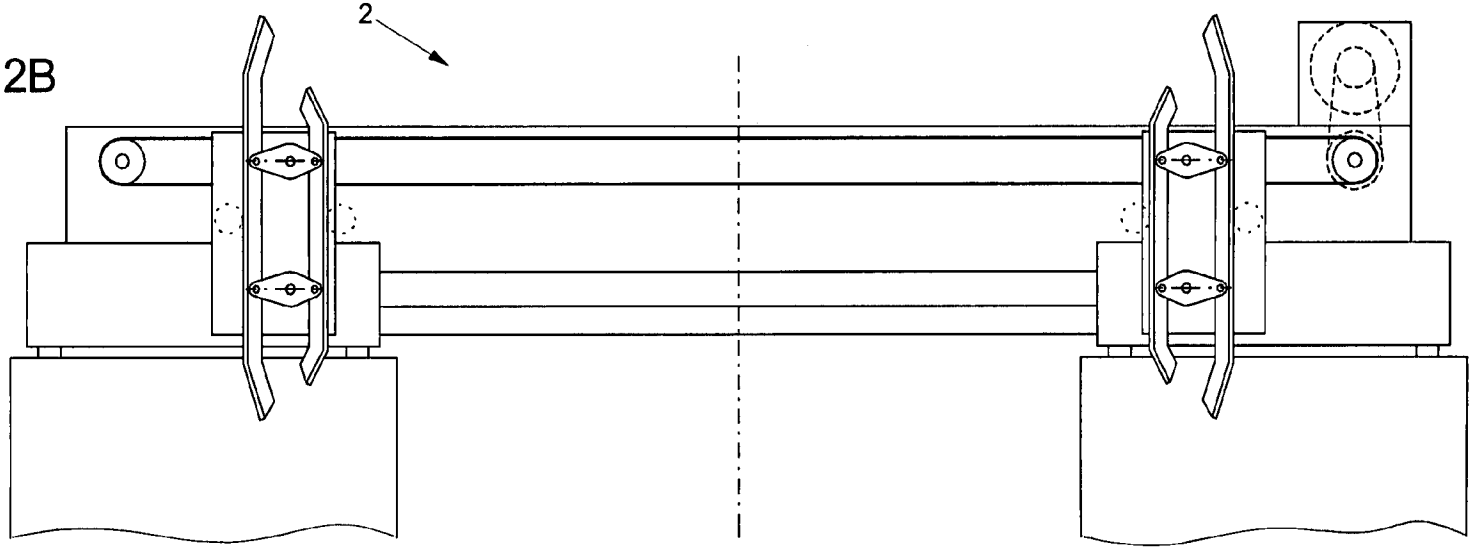
FIG. 2B is a view similar to FIG. 2A with entraining runners spread.

FIGS. 2A and 2B schematically show an elevator door drive device 2 of the above-described kind with two coupling mechanisms 14 for centrally closing multi-leaf doors. The center-symmetrical movement of two car door leaves 5.1, 5.2—and thus also the two shaft door leaves—is achieved in that the righthand car door leaf 5.1 is connected with a lower run 9.1, and the lefthand car door leaf 5.2 with an upper run 9.2, of the linearly acting drive means, which is moved by the drive unit 8 in opening or closing direction as required. Adjustment of the spacing between the entraining runners similarly takes place at the righthand and at the lefthand car door leaf by the drive unit 8 by way of the corresponding runs of the drive means 9. The principle of operation of the spacing adjustment is explained in connection with FIGS. 3A and 3C.

Figure 3A:
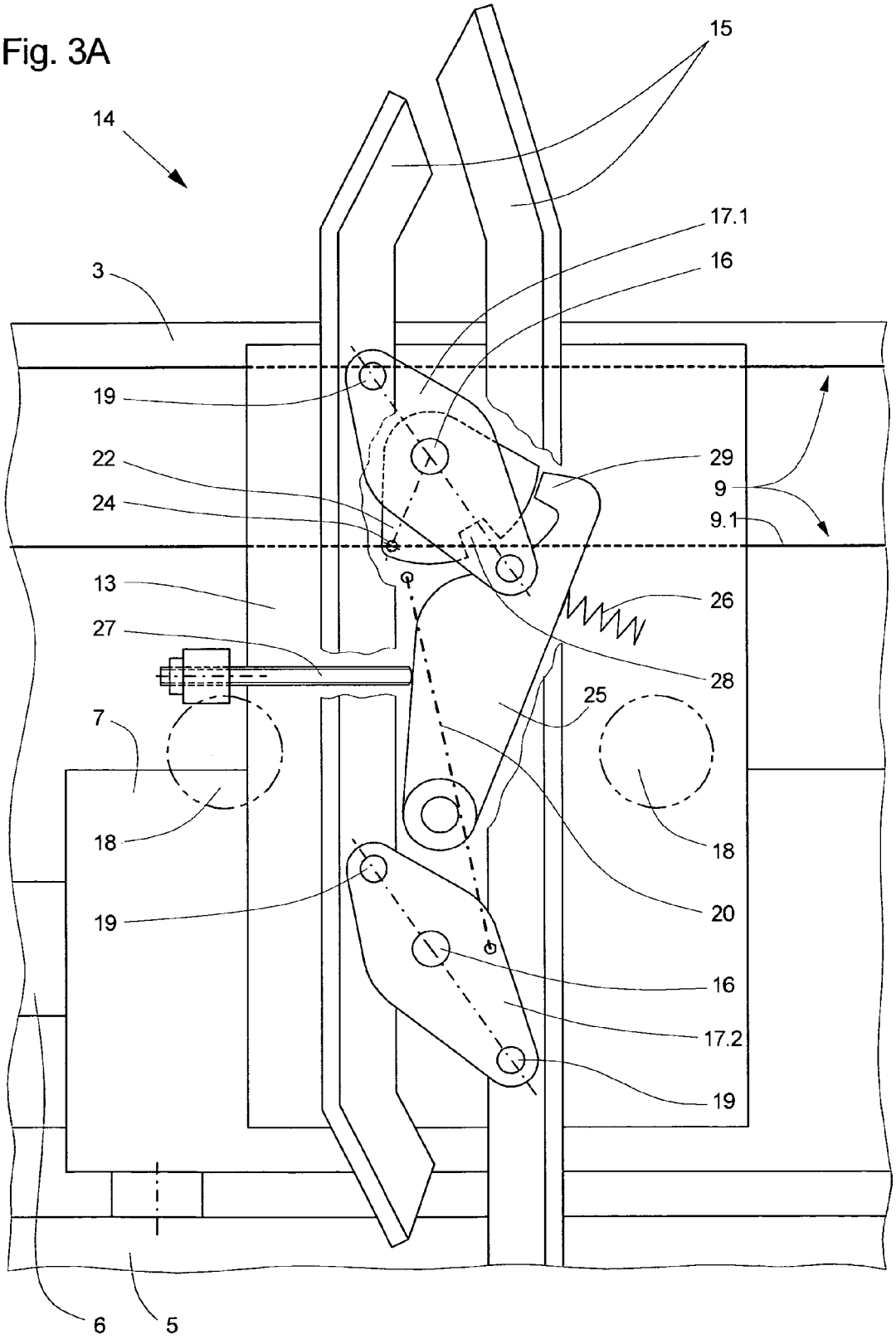
FIG. 3A is a detail view of the coupling mechanism of the door drive devices shown in the FIGS. 1A, 1B, 2A and 2B with the entraining runner blocking device according to the present invention in an unblocked setting.
Figure 3B:
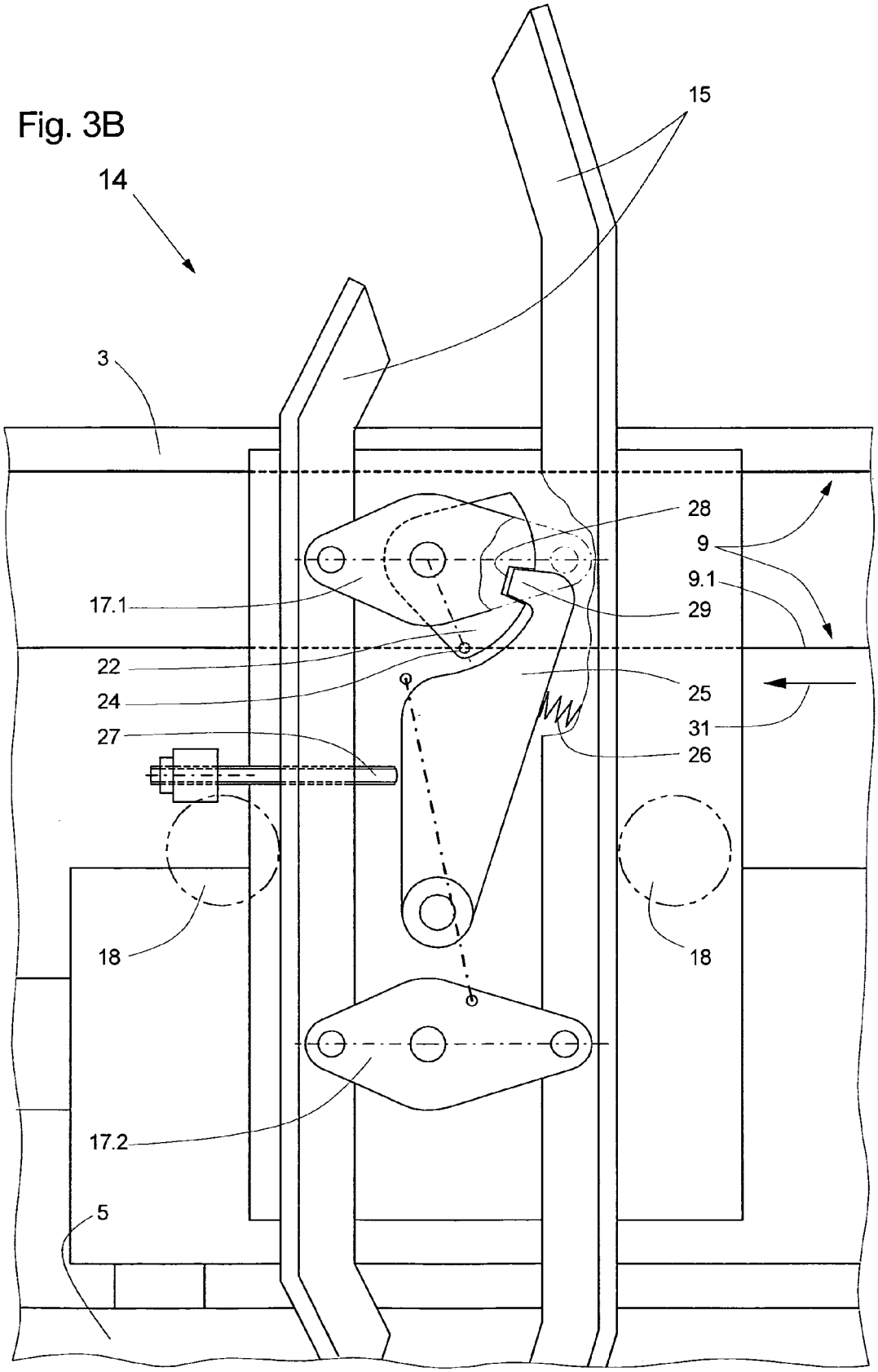
FIG. 3B is an enlarged view of the coupling mechanism according to FIG. 3A with the entraining runner blocking device in a blocked setting.

FIGS. 3A and 3B show a detailed view of the afore-described coupling mechanism 14. On the basis of FIGS. 3A and 3B it is explained in the following how the spacing between the entraining runners 15 is adjusted and how the exact position thereof is fixed in play-free manner during the door opening and door closing process.

As already mentioned, the base plate 13, on which the coupling mechanism 14 for transmitting the movement of the car door leaf to the shaft door leaf (not visible) associated therewith is mounted, is fastened on the suspension carriage 7 carrying the car door leaf 5 and guided at the guide rail 6. The coupling mechanism 14 essentially comprises the following components:

the two entraining runners 15;

the two double-armed adjusting elements 17.1, 17.2, which are each fixed at the respective pivot axle 16 mounted on the base plate 13 and each guide a respective entraining runner 15 at two respective pivot points 19;

a spreader spring 20 which has the effect that the entraining runners tend to adopt their setting spread from one another;

a pivot and blocking plate 22 which is fastened on the upper pivot axle 16 and at which the lower run 9.1 of the drive means 9 engages at a connecting point 24;

a catch 25 which is pivotably mounted on the base plate 13 and which can be brought into engagement with the pivot and blocking plate 22 by a catch spring 26; and a catch abutment 27 fixedly connected with the door support 3 and not moving with the door leaf 5.

The coupling mechanism 14 functions as follows: before the start of a door leaf opening process, i.e. in the case of closed car and shaft doors, the lower run 9.1 of the linearly acting drive means 9 exerts, by way of the connecting point 24, a closing force, which is directed to the left, on the pivot and blocking plate 22, which has the effect that the adjusting element 17.1 seated on the same pivot axle 16 adopts a setting in which the entraining runners 15 are spaced from one another as little as possible (unspread setting) and have a sufficient spacing from the coupling elements 18 at the shaft door leaf. The closing force is here opposed by abutments (not shown) of which one defines the unspread position of the entraining runners 15 and a second limits the closing movement of the entire coupling mechanism 14 with the car door leaf 5. The catch abutment 27 which is fixed on the door support 3 and against which the coupling mechanism 14 with the catch 25 has moved in the course of the last travel section of the door leaf closing movement, keeps the catch out of engagement with the pivot and blocking plate.

At the start of the door leaf opening process the lower run 9.1 of the drive means 9 moves to the right so that the pivot and blocking plate 22 begins to rotate together with the adjusting elements 17.1, 17.2 in counter-clockwise sense and the entraining runners are spread apart. The drive force for this spreading process is supplied at least partly by the mentioned spreading spring, so that in this movement phase no significant traction force is exerted by the drive means 9 on the coupling mechanism 14 and the displaceable car door leaf 5 connected therewith. As soon as the entraining runners 15 have attained their fully spread setting, the spreading movement is stopped by an abutment, which is not illustrated here and which acts on the entraining runners. The pivot movement of the pivot and blocking plate 22 is prevented from further pivoting and, in particular, in a setting in which a groove 28, which is present at its periphery, is disposed opposite a detent lug 29, which is formed to be complimentary therewith, of the catch 25. Since the pivot and blocking plate 22 can now no longer be further deflected, the drive force of the drive means 9 acts on the entire coupling mechanism 14 and thus also on the car door leaf 5, whereby the door leaf opening movement to the right is initiated. In the course of the first travel section, which measures less than six millimeters, of the door leaf opening movement the catch 25 moves away from the catch abutment 27 so that the catch detents by its detent lug 29 due to the force of the catch spring 26 in the groove 28 of the pivot and blocking plate 22 and blocks this precisely and in play-free manner in the correct spread setting of the entraining runners, in which the latter are led up to the coupling elements 18. This state is illustrated in FIG. 3B. Freedom of play between the detent lug 29 and the groove 28 can preferably be achieved in that these slightly interengage in a wedge manner.

In the case of the door leaf closing process the lower run 9.1, which is coupled with the pivot and blocking plate 22 by way of the connecting point 24, of the drive means 9 moves to the left. As shown in FIG. 3B, the pivot and blocking plate and with it the adjusting elements 17.1, 17.2 are blocked by the catch 25 in play-free manner in the setting in which the entraining runners 15 adopt their setting spaced from one another. The drive force therefore acts on the entire coupling mechanism 14 and the car door leaf 5 and moves this in closing direction (arrow 31). Less than six millimeters before the car door leaf 5 has reached its closed setting, the catch 25 impinges on the adjustable catch abutment 27 fixedly connected with the stationary door support 3, whereby the catch abutment in the course of this last travel section of the car door leaf closing movement moves the detent lug 29 of the catch 25 out of the groove 28 of the pivot and blocking plate 22 and unblocks the latter. The direction in which the catch abutment 27 in that case acts on the catch 25 substantially corresponds with the direction in which the detent lug 29 has to move out of the groove 28. Through appropriate selection of the spacing between the fulcrum of the catch and the point of action of the catch abutment it is possible to influence how large the last travel section of the car door leaf has to be in order to produce unblocking of the pivot and blocking plate 22. The pivot and blocking plate is now pivoted by the lower run 9.1 of the drive means 9 in clockwise sense until the adjusting elements 17.1, 17.2 connected therewith have reached the setting in which the entraining runners 15 adopt their position, which is defined by an abutment (not illustrated) and with smallest possible mutual spacing, in which they are spaced from the coupling elements 18. Thus the starting position shown in FIG. 3A in which the car door leaf 5 as also the shaft door leaf are closed and the elevator car ready for travel is again achieved.

Figure 3C:
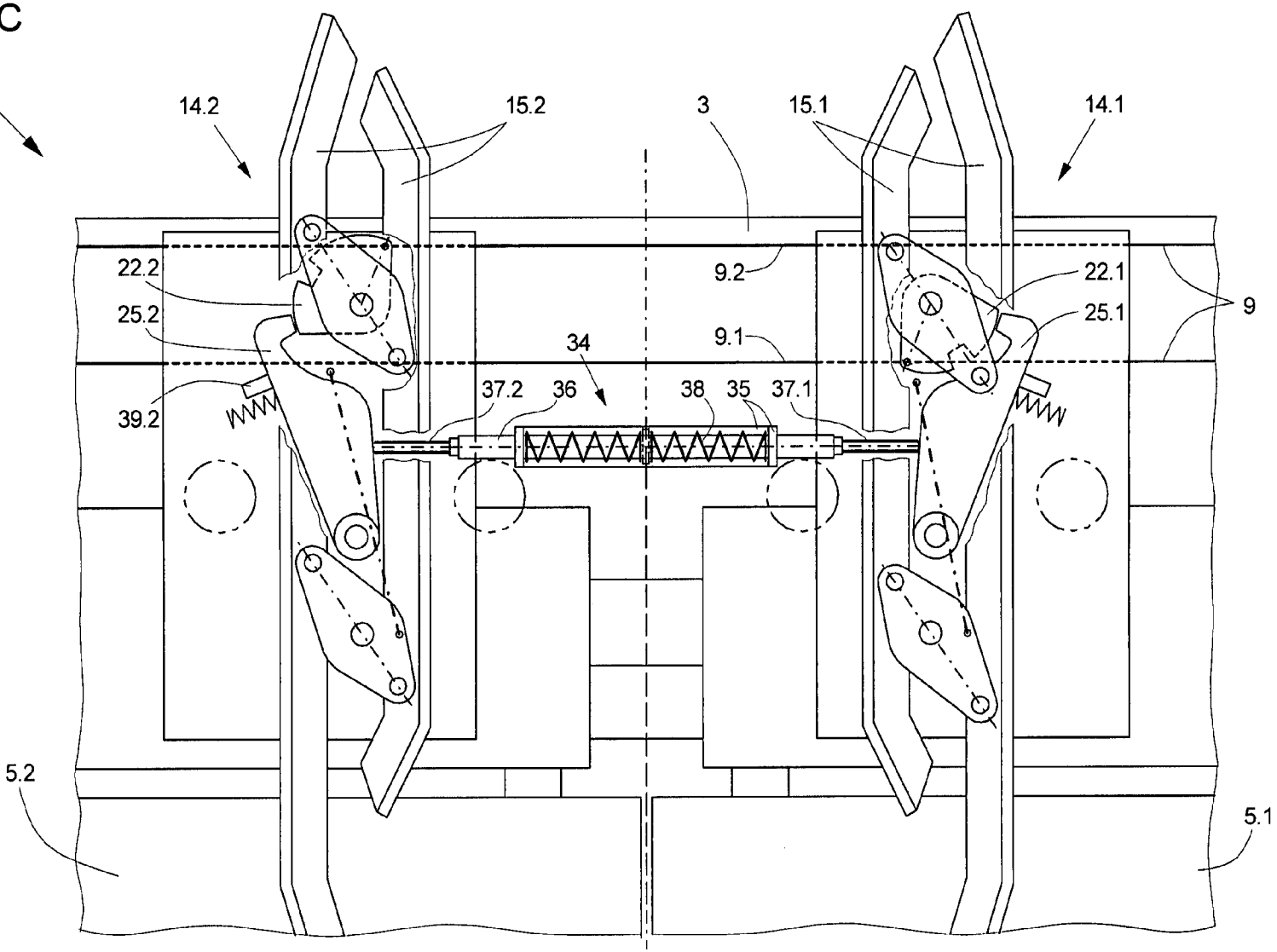
FIG. 3C shows a detail view of the coupling mechanism of a door drive device for a centrally closing multi-leaf door with a horizontally displaceable double catch abutment according to an alternate embodiment of the present invention.

FIG. 3C shows the elevator door drive device 2 according to the present invention for centrally closing multi-leaf doors with two coupling mechanisms 14.1, 14.2. The construction and mode of function of the two coupling mechanisms 14.1, 14.2 each associated with a respective one of the pair of car door leaves 5.1, 5.2 are identical with the construction and mode of function of the afore-described coupling mechanism 14 for single-leaf doors. The movement of the first car door leaf 5.1 as well as the actuation of the spreading process of entraining runners 15.1 mounted thereat in that case takes place by the lower run 9.1 of the drive means 9, and the movement of the second car door leaf 5.2 as well as the actuation of the spreading process of entraining runners 15.2 associated therewith takes place by the upper run 9.2 of the linearly acting drive means 9. A center-symmetrical movement of the first and second car and shaft door leaves is thereby achieved. In elevator operation the problem can arise that lateral deviations of the car door center from the respective shaft door center (displacements) arise. In the case of centrally closing multi-leaf doors such a situation has the consequence that on closing of the car and shaft door leaves symmetrically with respect to the car door center a first shaft door leaf reaches a shaft door central abutment (not visible in FIG. 3C), which defines the closed setting of the shaft door leaf and which is for the moment laterally displaced relative to the car door center, before a catch 25.1 of the first car door leaf 5.1 coupled with this shaft door leaf is brought by the associated catch abutment out of its engagement with the pivot and blocking plate. In this case spreading of the entraining runners 15.1 at this car door leaf cannot be cancelled, which leads to an operational disturbance.

As illustrated in FIG. 3C, this problem in the case of centrally closing multi-leaf doors is solved in that instead of catch abutments fixedly connected with the door support 3 there is used a double catch abutment 34 which comprises two abutment members 37.1, 37.2 which are laterally freely displaceable about their center setting and are adjustable in their mutual spacing. These abutment members are disposed each time at an end of an abutment rod 36 which is guided in a guide element 35, which is mounted at the door support 3, to be horizontally displaceable. A spring centering 38 ensures that in the unloaded state the double catch abutment 34 is automatically centered in a middle setting.

In the case of the afore-described problem with lateral deviations of the car door center from the shaft door center the car door leaf 5.2 corresponding with the second shaft door leaf not yet bearing against the shaft door central abutment is, for example as a consequence of resilient deformation of several elements participating in the closing process, pulled by the drive force a few millimeters closer to the theoretical center of the car door leaf than the two first door leaves blocked by the eccentric shaft door central abutment. In that case a catch 25.2 of the second car leaf 5.2 is pushed by the displaceable double catch abutment 34 up to a rearward limiting abutment 39.2 and brought out of engagement with an associated pivot and blocking plate 22.2. Since the second car door leaf 5.2 is drawn a few millimeters closer to the center of the car door leaf than the first, the abutment members 37.2, 37.1 of the displaceable double catch abutment 34 are displaced by the catch 25.2, which bears against the limiting abutment 39.2 thereof, of the second car door leaf 5.2 so far in the direction of the catch 25.1 of the first car door leaf 5.1 that this too is moved out of engagement with an associated pivot and blocking plate 22.1 so that the spreading of the two entraining runner pairs can be cancelled at the door closing process correctly concluded.

Figure 4A:
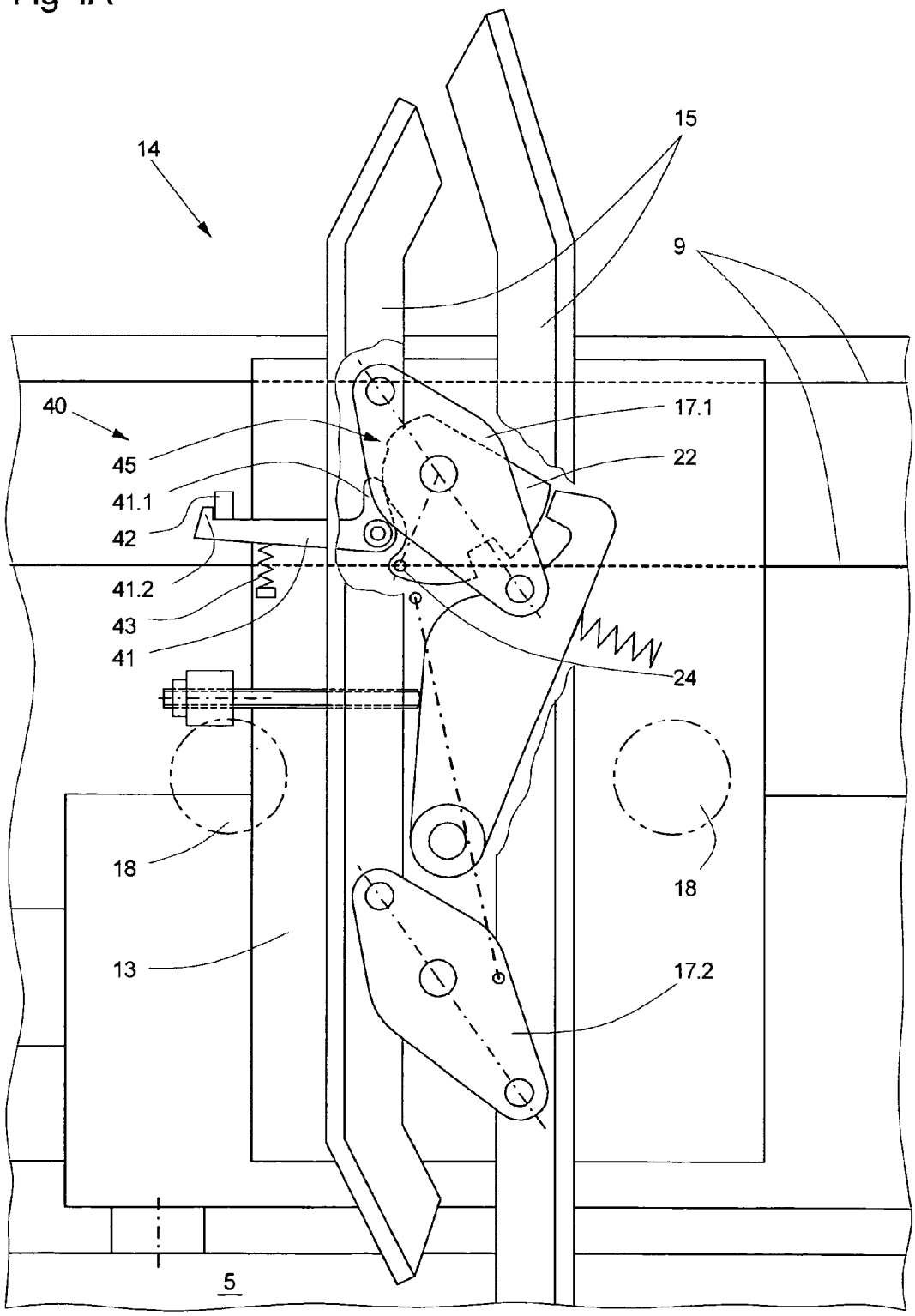
FIG. 4A is a schematic view of an elevator door drive device with the entraining runner blocking device according to the present invention and with a door leaf restraining device in a restraining setting.
Figure 4B:
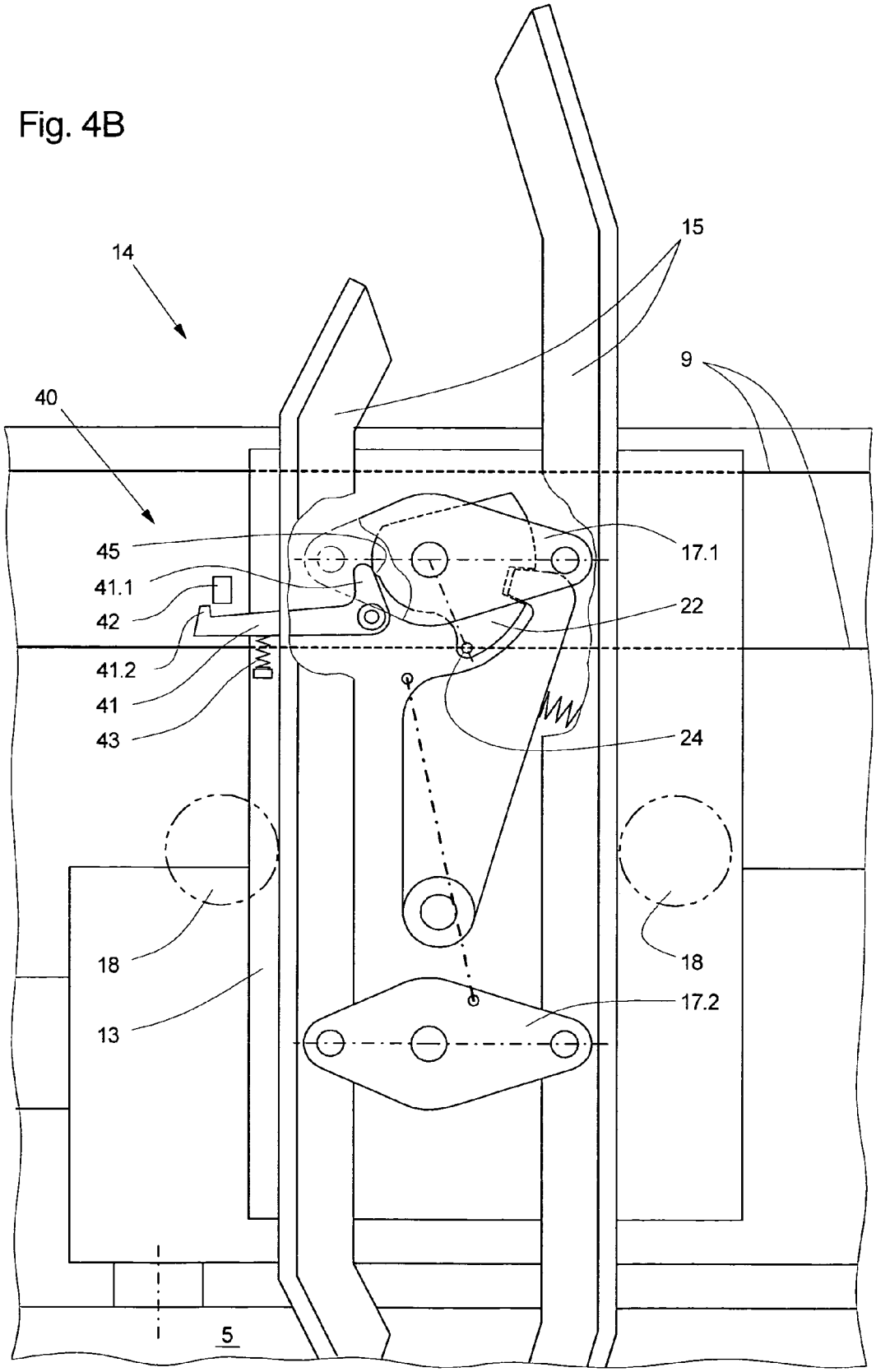
FIG. 4B shows the elevator door drive device according to FIG. 4A with the door leaf restraining device in a release setting.

FIGS. 4A and 4B show a variant of the elevator door drive device 2 according to the invention, in which the afore-described coupling mechanism 14 additionally has a restraining device 40 which ensures that at the beginning of the door leaf opening process the opening movement of the door leaf can begin only when the adjusting elements 17.1, 17.2 are pivoted, before the start of the door leaf opening movement, by the linearly acting drive means 9 into the setting in which the entraining runners are led up to the coupling elements 18 present at the shaft door leaves. The restraining device 40 essentially comprises the following components:

a double-armed restraining catch 41, which is pivotably mounted on the base plate 13 and of which at least a driven arm 41.1 is arranged in the plane of the pivot and blocking plate 22;

a restraining catch abutment 42 fixed on the door support 3 fixedly connected with the elevator car 1;

a compression spring 43 biasing the restraining catch 41 towards the restraining catch abutment 42; and the afore-described pivot and blocking plate 22 which is driven by the linearly acting drive means 9 and in which for the purpose of actuation of the restraining catch 41 a part of its periphery is constructed as a cam disc.

The manner of operation of the restraining device is readily recognizable from FIGS. 4A and 4B. FIG. 4A shows the coupling mechanism 14 in its starting position in which the drive unit by way of the linearly acting drive means 9 keeps the adjusting elements 17.1, 17.2 fixed in a setting in which the entraining runners 15 are spaced from the coupling elements 18 (coupling rollers) present at the shaft door leaf. At the start of a door leaf opening process a force directed to the right is, as described in the foregoing, exerted by the drive means 9 via the connecting point 24 on the pivot and blocking plate 22, whereby the adjusting elements 17.1, 17.2 are so pivoted in counter-clockwise sense that the entraining runners 15 are spread to maximum mutual spacing and are led up to the said coupling elements 18. Only after spreading of the entraining runners has produced a play-free coupling between the car door leaf 5 and the corresponding shaft door leaf and unlocking of the shaft door leaf has been effected shall the force, which is transmitted by way of the drive means 9 to the coupling mechanism 14, set the actual opening movement of the car door leaf 5 and the shaft door leaf in motion. In order to ensure this sequence, i.e. in order to release the opening movement of the car door leaf 5 only when the spreading of the entraining runners is almost complete, a detent 41.2 of the restraining catch 41 is in engagement with the restraining catch abutment 42 up to this point in time and blocks the base plate 13 and thus the car door leaf 5 relative to the door support 3. Only shortly before the end of the pivot movement of the adjusting elements 17.1, 17.2 is the driven arm 41.1 of the restraining catch 41 so pivoted by a diametral offset (cam) 45, which is present at the periphery of the pivot and blocking disc 22, that the detent 41.2 of the restraining catch 41 is moved out of its engagement with the restraining catch abutment 42. This situation is illustrated in FIG. 4B. During the entire opening and closing process the restraining catch—positioned by the periphery diameter 30 becoming larger after the diametral offset 45 on the driven arm 41.1—remains in the unlatched setting. As soon as the car door leaf 5 and with it the corresponding shaft door leaf have again reached their closed setting, the pivot and blocking plate 22 is pivoted back by the drive means 9 in clockwise sense, whereby the adjusting elements 17.1, 17.2 move the entraining runners 15 back into their setting spaced from the coupling elements 18. Shortly after the start of the return pivot movement the driven arm 41.1 of the restraining catch 41 passes from the peripheral region of the pivot and blocking plate 22 with the larger diameter over the diametral offset 45 to the peripheral region with the smaller diameter, so that the detent 41.2 of the restraining catch 41 is moved by the compression spring 43 back into engagement with the restraining catch abutment 42.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator door drive device for opening and closing at least one car door leaf and a corresponding shaft door leaf, comprising:

a coupling mechanism mounted at the car door leaf for transmitting the movement of the car door leaf to the shaft door leaf, said coupling mechanism including two entraining runners oriented parallel to a travel direction of the elevator car and mounted on adjusting means, said adjusting means being pivotable in opposite directions about a pivot axis for adjusting spacing between said entraining runners, said entraining runners acting on at least one coupling element arranged at the shaft door leaf;

a drive unit transmitting closing and opening movements to the car door leaf by way of a linearly acting drive means, said drive means engaging the car door leaf through said coupling mechanism to lead said entraining runners to engage the at least one coupling element before the start of the door leaf opening movement and moving said entraining runners back to a setting spaced from the at least one coupling element after an end of the door leaf closing movement, wherein said adjusting means has a groove that is radially spaced from said pivot axis, and including a detent lug on a catch and being complementary with said groove to temporarily block a pivot movement of said adjusting means in both of the pivot directions; and wherein the car and the shaft have doors with at least two centrally closing door leaves and including two of said coupling mechanisms each mounted at a respective one of the car door leaves, a catch abutment arranged between said catches of said two coupling mechanisms, said catch abutment being displaceable in a movement direction of the two door leaves, said catch abutment moving by a respective one of two ends a respective one of said two catches away from an engagement position with a corresponding one of said adjusting means.

2. The elevator door drive device according to claim 1 wherein said adjusting means includes a pair of adjusting elements pivotally connected between said entraining runners.

3. The elevator door drive device according to claim 1 wherein said adjusting means includes a blocking plate having said groove formed therein.

4. The elevator door drive device according to claim 1 wherein said groove and said detent lug come into mutual engagement and produce a blocking of the pivot movement of said adjusting means effective in both of the pivot directions when said drive means has before the start of a door leaf opening movement brought said entraining runners to a mutual spacing in which said entraining runners engage the at least one coupling element.

5. The elevator door drive device according to claim 1 wherein said catch abutment is fixedly connected with the elevator car and upon which said catch impinges at the start of a last travel section of the door leaf closing movement, whereby during covering of this last travel section the blocking of the pivot movement of said adjusting means by said catch is canceled and wherein said catch and said catch abutment are so shaped and arranged that an abutment force acting on said catch acts approximately in a same direction in which a complementary shaped portion of said catch moves away from said groove.

6. The elevator door drive device according to claim 5 wherein said adjusting means, said catch and said catch abutment are shaped such that a length of the last travel section of the door leaf closing movement required for canceling the blocking of the pivot movement of said adjusting means by said catch is less than six millimeters.

7. The elevator door drive device according claim 5 wherein said catch is a lever pivotably mounted on a component connected with the car door leaf and the point of impinging of said catch abutment on said catch is such that the complementary shaped portion of said catch at said adjusting means moves in the course of the last travel section of the door leaf closing movement away from the engagement position by a travel which is greater than the last travel section.

8. The elevator door drive device according to claim 1 including a restraining device which upon initiation of a door leaf opening movement enables displacement of the car door leaf when closed only when said adjusting means before the start of the door leaf opening movement are pivoted by said drive means into the setting in which said entraining runners are led up to the at least one coupling element.

9. The elevator door drive device according to claim 8 wherein said restraining device includes a pivotable restraining catch which locks the car door leaf in its closed setting relative to the elevator car and which is so coupled with said adjusting means that the locking is cancelled when said adjusting means before the start of the door leaf opening movement arc pivoted by said drive means into the setting in which said entraining runners are led up to the at least one coupling element.

10. The elevator door drive device according to claim 9 wherein said adjusting means includes two adjusting elements and said coupling between said adjusting means and said restraining catch is present at a first one of said adjusting elements with a diametral offset which moves said restraining catch into an unlocked setting when said adjusting elements before the start of the door leaf opening movement are pivoted by said drive means into a setting in which said entraining runners are led up to the at least one coupling element.

11. An elevator door drive device for opening and closing at least one car door leaf and a corresponding shaft door leaf, comprising:

a coupling mechanism mounted at the car door leaf for transmitting the movement of the car door leaf to the shaft door leaf, said coupling mechanism including two entraining runners oriented parallel to a travel direction of the elevator car and mounted on adjusting means, said adjusting means being pivotable in opposite directions about a pivot axis for adjusting spacing between said entraining runners, said entraining runners acting on at least one coupling element arranged at the shaft door leaf;

a drive unit transmitting closing and opening movements to the car door leaf by way of a linearly acting drive means, said drive means engaging the car door leaf through said coupling mechanism to lead said entraining runners to engage the at least one coupling element before the start of the door leaf opening movement and moving said entraining runners back to a setting spaced from the at least one coupling element after an end of the door leaf closing movement, wherein said adjusting means has a groove that is radially spaced from said pivot axis, and including a detent lug on a catch and being complementary with said groove to temporarily block a pivot movement of said adjusting means in both of the pivot directions;

a catch abutment fixedly connected with the elevator car and upon which said catch impinges at the start of a last travel section of the door leaf closing movement, whereby during covering of this last travel section the blocking of the pivot movement of said adjusting means by said catch is canceled and wherein said catch and said catch abutment are so shaped and arranged that an abutment force acting on said catch acts approximately in a same direction in which a complementary shaped portion of said catch moves away from said groove; and wherein said adjusting means, said catch and said catch abutment are shaped such that a length of the last travel section of the door leaf closing movement required for canceling the blocking of the pivot movement of said adjusting means by said catch is less than six millimeters.

12. An elevator door drive device for opening and closing at least one car door leaf and a corresponding shaft door leaf, comprising:

a coupling mechanism mounted at the car door leaf for transmitting the movement of the car door leaf to the shaft door leaf, said coupling mechanism including two entraining runners oriented parallel to a travel direction of the elevator car and mounted on adjusting means, said adjusting means being pivotable in opposite directions about a pivot axis for adjusting spacing between said entraining runners, said entraining runners acting on at least one coupling element arranged at the shaft door leaf;

a drive unit transmitting closing and opening movements to the car door leaf by way of a linearly acting drive means, said drive means engaging the car door leaf through said coupling mechanism to lead said entraining runners to engage the at least one coupling element before the start of the door leaf opening movement and moving said entraining runners back to a setting spaced from the at least one coupling element after an end of the door leaf closing movement, wherein said adjusting means has a groove that is radially spaced from said pivot axis, and including a detent lug on a catch and being complementary with said groove to temporarily block a pivot movement of said adjusting means in both of the pivot directions;

a catch abutment fixedly connected with the elevator car and upon which said catch impinges at the start of a last travel section of the door leaf closing movement, whereby during covering of this last travel section the blocking of the pivot movement of said adjusting means by said catch is canceled and wherein said catch and said catch abutment are so shaped and arranged that an abutment force acting on said catch acts approximately in a same direction in which a complementary shaped portion of said catch moves away from said groove; and wherein said catch is a lever pivotably mounted on a component connected with the car door leaf and the point of impinging of said catch abutment on said catch is such that the complementary shaped portion of said catch at said adjusting means moves in the course of the last travel section of the door leaf closing movement away from the engagement position by a travel which is greater than the last travel section.

* * * * *